US005295056A

United States Patent [19]

Peck

[11] Patent Number: 5,295,056

[45] Date of Patent: Mar. 15, 1994

[54] EXTERIOR FRAMING PROJECTOR

[76] Inventor: Martin J. Peck, N140 W13843 Cedar La., Germantown, Wis. 53022

[21] Appl. No.: 891,420

[22] Filed: May 29, 1992

[51] Int. Cl.[5] ..... F21V 13/12; F21V 31/02

[52] U.S. Cl. ..... 362/267; 362/277; 362/321; 362/362

[58] Field of Search ..... 362/267, 26 B, 277, 362/285, 284, 319, 321, 362, 373

[56] References Cited

U.S. PATENT DOCUMENTS

| | | | |
|---|---|---|---|
| 3,069,536 | 12/1962 | Dion et al. | 362/321 |
| 4,419,716 | 12/1983 | Koo | 362/373 |
| 4,462,067 | 7/1984 | Altman | 362/277 |
| 4,546,420 | 10/1985 | Wheeler et al. | 362/373 |
| 4,701,833 | 10/1987 | Bornhorst | 362/373 |
| 4,729,078 | 3/1988 | Skevin | 362/373 |
| 4,899,267 | 2/1990 | Mardon | 362/321 |

*Primary Examiner*—Richard R. Cole
*Attorney, Agent, or Firm*—Butler & Binion

[57] ABSTRACT

An exterior framing projector is adapted for use in all weather conditions and includes a hermetically sealed housing with the clear cover over one end through which the light image is projected. The components of the projector are mounted and sealed within the housing and may be positioned on a base carried in the housing with the various components mounted in a manner to be adjusted relative to one another to control focus and image size. A lamp positioning system is provided for assuring accurate alignment of the lamp with the ellipsoidal reflector of the projector.

28 Claims, 3 Drawing Sheets

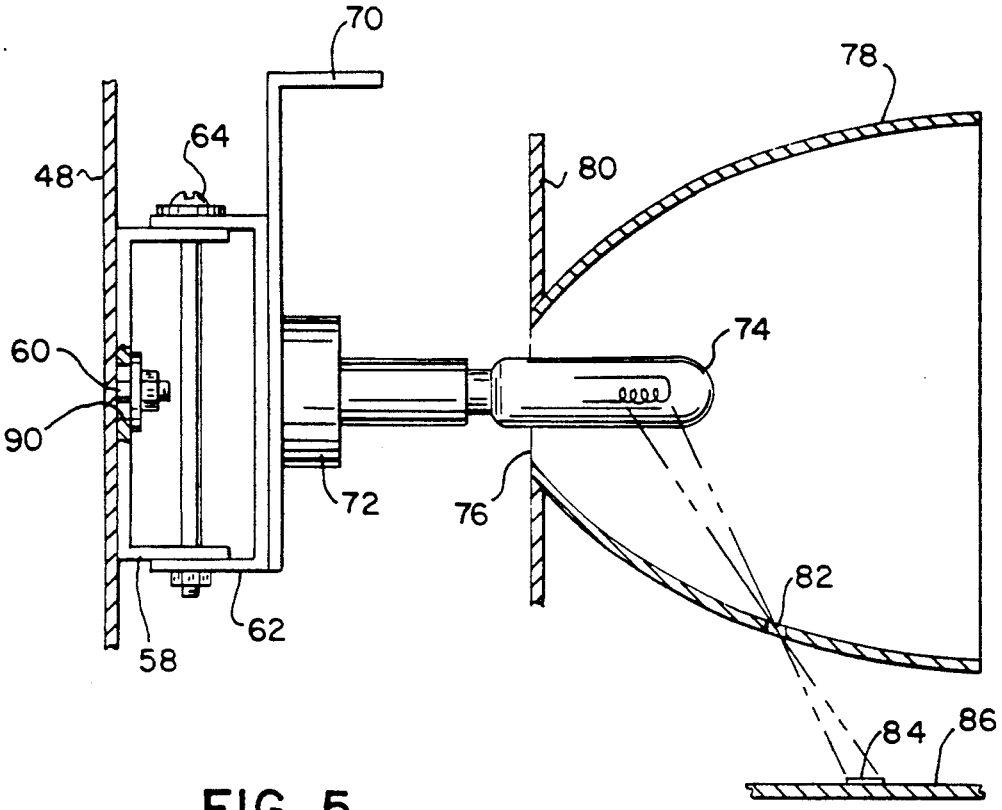
FIG. 5
FIG. 6
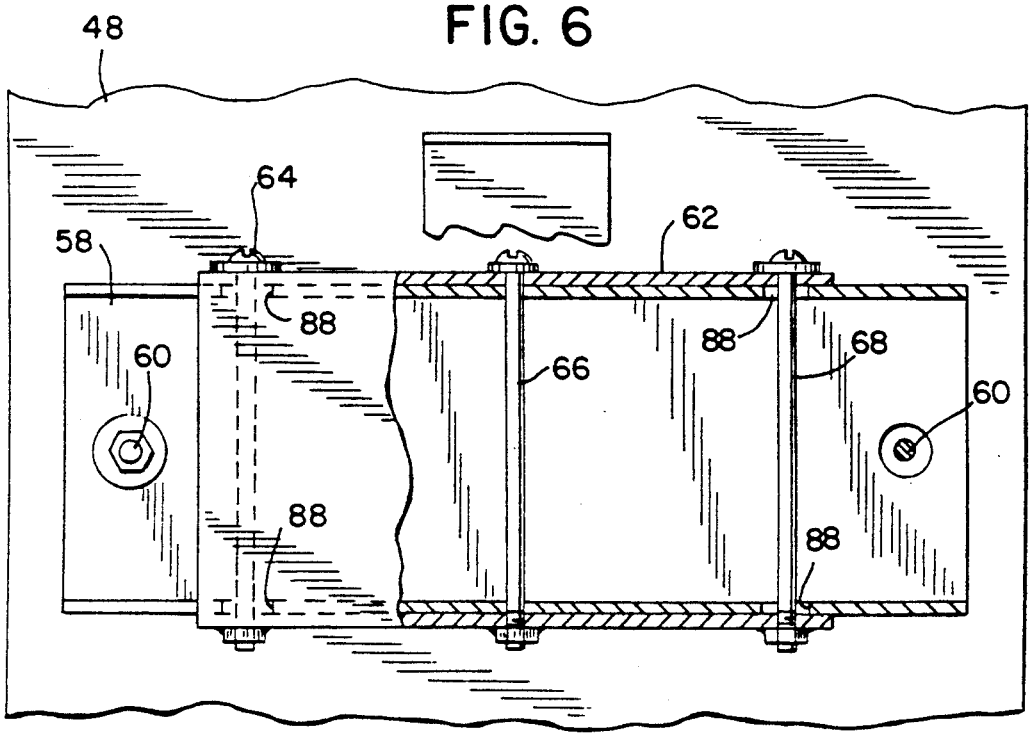

EXTERIOR FRAMING PROJECTOR

CROSS-REFERENCE TO RELATED APPLICATION

This application is related to an application entitled "Outdoor Framing Projector" Ser. No. 07/861,181, invented by Rupert O. Yantz, Richard A. Johnson and Martin J. Peck and filed on Mar. 31, 1992.

BACKGROUND OF THE INVENTION

1. Field of the Invention

The invention is related to framing projectors and is specifically directed to a framing projector adapted for outdoor use.

2. Description of the Prior Art

Framing projectors are well known. Typically, they are lighting fixtures used in stage productions for framing a specific object or area on a stage or for projecting an image on a flat surface behind the stage, such as a skyline or the like to provide a backdrop for a stage play. Such projectors have been almost exclusively limited to indoor use. This is primarily because these projectors are designed to permit heated air created by the lamp to escape from the housing of the projector, which, while desirable, permits the external elements into the housing, possibly damaging the projector components and potentially creating an electrical shortage if the projector were used for extended period of times in uncontrolled conditions such as exterior applications.

However, it remains desirable to use framing type projectors in external environments to, for example, project a specific image on the exterior surface of the building or a billboard or the like or to frame an object to be illuminated without spillover of light to undesired areas. Use of a framing projector eliminates light trespass by precisely controlling the cut out and shape of the light pattern to eliminate light or glare in unwanted areas. Rooftops, flags or details around windows could be illuminated without undesirable spill. Entrances, statues or sidewalks could be illuminated without glare on pedestrians or motorists or other objects. Sculptures, statues, tables or showroom merchandise could be illuminated by projecting precise outlines of the object as seen from the proper location.

Such a projector would provide good illumination of other normally inaccessible areas such as hazardous areas, high temperature areas, smoke stacks or other distant objects. However, framing projectors of the prior art must be mounted in a controlled environmental setting, precluding such uses. Therefore, there remains a need for a framing projector adapted for external installation and use.

SUMMARY OF THE INVENTION

The framing projector of the subject invention is specifically adapted for exterior use. It includes a housing which is hermetically sealed for enclosing the lamp, reflector, lens system and template/shutter system. The housing is hermetically sealed to protect the components from external elements. In the preferred embodiment of the invention, the housing is of a substantially rectangular cross section and includes opposite ends, one of which is covered with a clear transparent cover. The cover is attached to the housing and the seal is placed therebetween to hermetically seal the housing interior. The outer surface of the housing is smooth and has no externally projecting knobs, handles or other components. The housing thus presents a streamlined enclosure for improved appearance that also eliminates tampering by unauthorized personnel.

The components of the lighting system may be mounted on a base which is carried in the housing. In the preferred embodiment of the invention, the lens system and template/shutter system are mounted on the base in a manner which permits adjustment of the relative position between the lens system and the template/shutter system for focusing the projector and controlling the size of the projected image. Cooling of these components is provided by natural circulation of air within the housing which is facilitated by openings formed through the base.

The reflector is also adjusted relative to the lamp to assure proper positioning of the shutter relative to the lamp for proper aiming of the projector. The lamp utilized may be a standard quartz lamp, or may be higher efficiency metal halide type with ballast and associated equipment.

In the illustrated embodiment of the projector, the sidewalls of the housing include elongated tracks extending longitudinally along the housing and adapted for slidably receiving the base, whereby the base may be slidably inserted into and removed from the housing through an open end of the housing. The base includes a cover plate which is adapted to close the end of the housing when the base is fully inserted in the housing. A seal is positioned between the cover plate and the housing to hermetically seal the interior of the housing and protect it from external elements. The base may include one or more elongate channels for receiving mounting tabs on the lens system and the template/shutter system components, whereby the lens system and the template/shutter system may be slidably moved relative to the base for relative positioning of the components of the projector system to provide proper focusing and image sizing.

In the preferred embodiment of the invention, the lamp socket is mounted on a bracket system permitting both vertical and horizontal adjustment of the lamp socket relative to the reflector. The reflector includes an aiming system, whereby the lamp may be accurately positioned relative to the reflector to assure proper direction of the beam. In the preferred embodiment the aiming system comprising a through aperture in the sidewall of the reflector through which light may pass. A target is positioned on an interior wall of the projector, and when the light is directed on the target, the lamp is properly positioned relative to the reflector to assure proper calibration and intensity of the light beam.

The exterior framing projector of the subject invention is particularly well suited for lighting applications where it is desirable to frame the lighted object to assure narrow overflow light or to reduce light spillage into adjacent areas. The framing projector of the subject invention is also useful for directing images such as signs or graphics on an exterior surface of the building, billboard or the like. The hermetically sealed housing protects the components of the projector from external elements, permitting use of the framing projector in exterior applications in all weather conditions.

It is, therefore, an object and feature of the subject invention to provide a framing projector suited for all weather exterior use.

It is also an object and feature of the subject invention to provide an exterior framing projector with a hermetically sealed housing to protect the interior components of the projector from the environment.

It is a further object and feature of the invention to provide an exterior framing projector wherein the size, shape and focus of the projected image may be controlled.

It is yet another object and feature of the subject invention to provide an exterior framing projector having a lamp socket which may be aligned for optimum intensity after the lamp has been installed in the system.

Other objects and features of the invention will be readily apparent from the accompanying drawings and detailed description of the preferred embodiment.

BRIEF DESCRIPTION OF THE DRAWINGS

The drawings illustrate the best mode presently contemplated of carrying out the invention.

FIG. 5 is a side view of the lamp and reflector, partially in section, showing the end system of the subject invention.

FIG. 6 is a front plan view, partially in section, of the reflector mounting bracket shown in FIG. 4.

DETAILED DESCRIPTION OF THE PREFERRED EMBODIMENT

Figure 1:
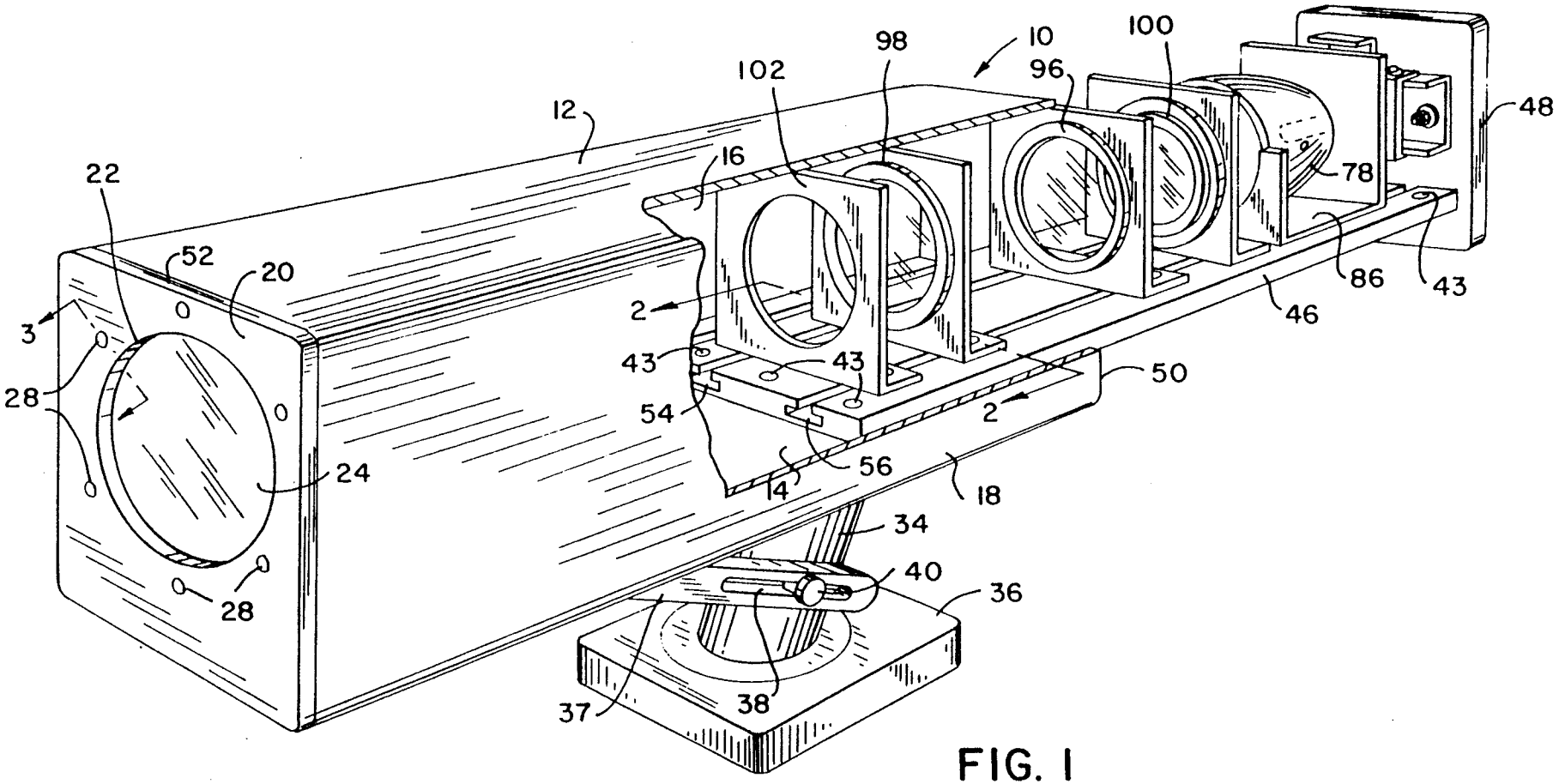
FIG. 1 is a perspective view, partially in section, of the exterior framing projector of the subject invention.

The exterior framing projector of the subject invention is shown in FIG. 1 and includes an outer housing 10 having a top wall 12, a bottom wall 14, and opposite sidewalls 16 and 18. As shown there are no external knobs, handles, levers or the like projecting from the housing 10 so that walls 12, 14, 16 and 18 have planar outer surfaces which present a smooth, streamlined appearance. In the preferred embodiment of the invention, the housing 10 has opposite open ends. The forward end, as drawn, of the housing 10 includes a cover plate 20 having a through opening 22 therein. The opening 22 includes a transparent or clear cover 24.

Figure 3:
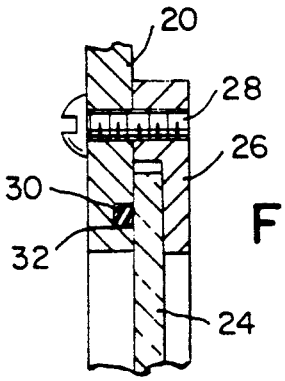
FIG. 3 is a partial section view, enlarged for clarity, taken generally along the line 3—3 of FIG. 1.

As is better shown in FIG. 3, the transparent cover 24 is sandwiched between the cover plate 20 and a mounting ring 26. The mounting ring 26 is secured to the cover plate 20 by suitable fasteners such as the threaded screws 28. In the preferred embodiment of the invention, an O-ring 30 is mounted in an annular channel 32 and forms a hermetically tight seal between the transpaprent cover 24 and the cover plate 20 for sealing interior of the housing against external weather conditions.

The housing 10 is mounted on a pedestal type post 34 (FIG. 1) having a support stand 36 which may be secured to a post, or other solid surface. The support stand 36 may be enlarged to accommodate a required ballast for a metal halide type lamp, if necessary. In the preferred embodiment, the upper end of the post 34 is hinged relative to the housing and an adjustment bracket 37 is provided with an elongated slot 38 and a set screw 40. The upper end of the bracket 36 is secured to the housing, and the tilt of the frame projector may be controlled by sliding the bracket relative to the post 34 and tightening the screw 40 when the framing projector is properly positioned. The framing projector may rotate side-to-side through an adjustment between post 34 and stand 36 and locked with a set screw (not shown).

Figure 2:
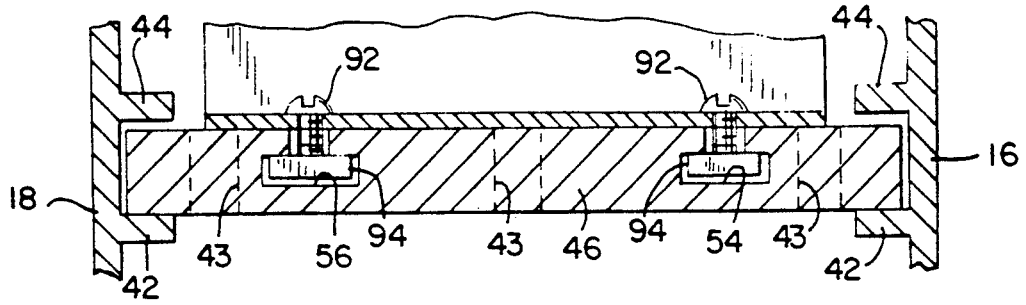
FIG. 2 is a section view taken generally along the line 2—2 of FIG. 1.

As is better shown in FIG. 2, the sidewalls 16 and 18 each include a pair of elongated, spaced apart rails 42 and 44 for defining a track for receiving a base 46. The interior components of the framing projector may all be mounted directly on the base 46 and the base may be inserted into the housing 10 through the open end, and guided along the tracks provided by the rails 42 and 44, both clearly shown in FIG. 1. In the preferred embodiment of the invention, the rearward end of the base 46 includes an upstanding cover plate 48 which is adapted for closing the open end of the housing 10 when the base is fully inserted in the housing along the tracks in the sidewalls 16 and 18.

In assembly of the framing projector, a resilient seal is provided at 50 along the open outer end of the housing 10 for sealing the junction between the rear cover plate 48 and the housing 10 when the base is fully installed in the housing. A seal is also provided between the front cover plate 20 and the housing 10 as at 52 for hermetically sealing the forward opening of the housing.

Cooling of the components within housing 10 is provided by natural circulation of air. This air circulation is facilitated by openings 43 formed through base 46. Openings 43 permit air movement between the top interior of housing 10 and a channel formed between bottom wall 14 and base 46.

The base includes a pair of T-shaped channels 54 and 56 extending longitudinally along the base and positioned and spaced apart parallel relationship. The channels 54 and 56 are adapted for receiving components of the framing projector and mounting them on the base, as will be described. In the preferred embodiment of the invention, a lamp system is mounted directly on the rear cover plate 48, as shown in FIG. 5. Specifically, a first U-shaped bracket 58 is suitably mounted, as at 60, directly on the cover plate 48. A second U-shaped bracket 62 is mounted on the first U-shaped bracket by a plurality of through bolts 64, 66 and 68. A heat sink/handle 70 may be mounted directly on the wall of the U-bracket 62. The lamp socket 72 is mounted directly on the heat sink 70 and the bracket 62 and is adapted for receiving the lamp 74. In the preferred embodiment of the invention, the lamp 74 is adapted to pass through the rear opening 76 of a ellipsoidal reflector 78. A vertical deflector plate 80 may be positioned at the rearward end of the reflector 78 for support.

As is better shown in FIG. 1, the lens system is mounted directly on the base 46 and is adapted to be positioned in axial alignment with the lamp 74 and the longitudinal axis of the housing 10, as defined by the center of the circular window 22.

In order to assure proper alignment of the lamp 74 relative to the reflector 78, the preferred embodiment of the subject invention includes an aiming system comprising a through aperture 82 in the sidewall of the reflector 78 and a target 84 provided on an interior wall of the apparatus. When the light beam generated by the lamp 74 passes through aperture 82 and is directed onto the target 84, the lamp 74 is properly aligned with the reflector 78. In order to provide adjustment of the lamp relative to the reflector, the mounting bracket upon which the lamp is mounted is adjustable relative to the base and hence to the lens system.

Figure 4:
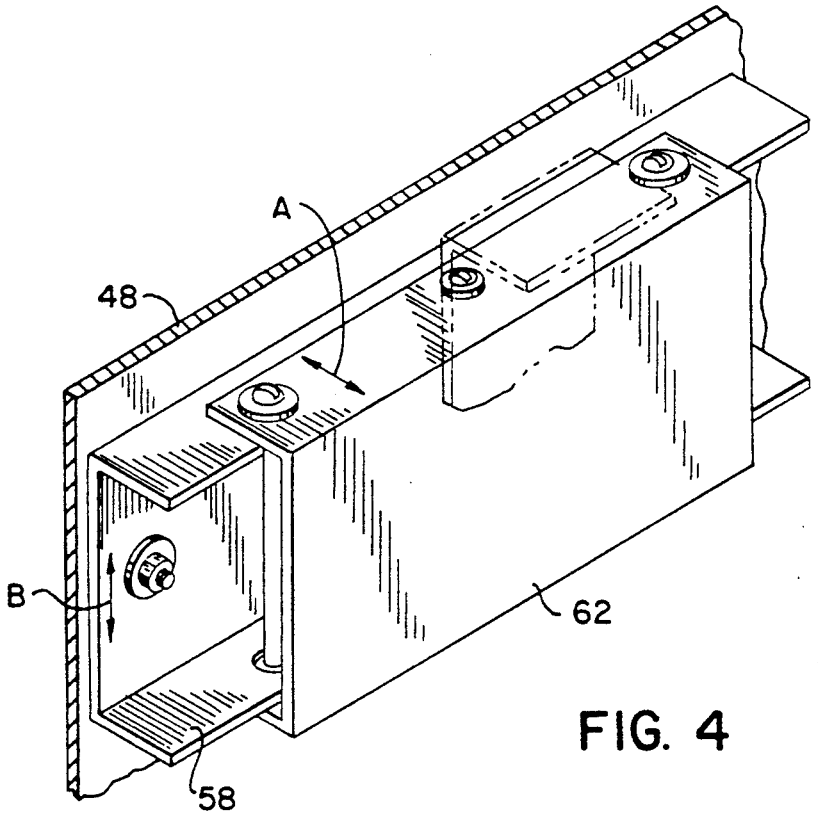
FIG. 4 is a perspective view, enlarged for clarity, of the reflector mounting bracket for the exterior framing projector of FIG. 1.

As is shown in FIG. 6, the through bolts 68, 66 and 64 mount the outer U-shaped bracket 62 on the inner U-shaped bracket 58. The outer bolts 64 and 68 pass through enlarged slots or holes 88 in the inner U-shaped bracket 58, permitting the outer bracket 62 to pivot about the axis defined by the middle bolt 66 permitting adjustment of the lamp in the direction of the arrow A, as shown in FIG. 4.

Where desired, the mounting holes in the lower bracket 58 for mounting the screws 60 may be also enlarged, as shown at 90 (FIG. 5), to permit vertical adjustment of the lamp, as indicated by the arrow B in FIG. 4. This mounting system permits both vertical and horizontal adjustment of the lamp to assure proper alignment between the lamp 74 and the reflector 78.

As is more clearly shown in FIGS. 1 and 2, the various components of the projector system may be mounted on a plurality of L-shaped plates including a pair of through holes in alignment with the T-shaped channels 54 and 56 (FIG. 2). Through holes are provided in the base of each plate for receiving fasteners such as the threaded screws 92, which extend downwardly into the respective channels 54 and 56. A tapped nut 94 may be positioned in the enlarged portion of the channels 54 and 56 for receiving each screw 92. When the screw is loosened relative to the nut, the plate may be slidably moved along the channels 54 and 56 for adjusting the relative position of the various components of the lamp system. When the screws are tightened, the plate is tightened down against the base 46 for holding the component in position.

In the preferred embodiment of the invention, a lens system comprising a first lens member 96 and a second lens member 98 is positioned in the appropriate location on the base 46. A template/shutter system 100 is positioned behind the lens 96 and in advance of the lamp 74 and the reflector 78 near the focal point of the reflector 78 to adjust the shape of the projected image. Where desired, color filter holder 102 may be positioned on the base in advance of the lens 98. By utilizing the base 46 and channels 54 and 56 of the subject invention, the relative position of the lens system components 96 and 98, may be adjusted relative to one another to assure proper focus of the projected beam and to control size, where desired.

The subject invention provides an ideal exterior lighting source for controlled object lighting and image projection in an exterior environment. While certain embodiments and features of the invention have been shown and described in detail herein, it should be understood that the invention encompasses all modifications and enhancements within the scope and spirit of the following claims.

I claim:

1. An exterior framing projector for projecting a framed light image in an outside environment, the projector comprising:

a. a housing having top, bottom, and opposite side walls and opposite ends, at least one of which is open;

b. a clear cover over said one open end;

c. a seal between the cover and the housing for hermetically sealing the housing;

d. a base carried in the housing;

e. a lamp mounted on the base and in axial alignment with the cover;

f. a reflector mounted on the base and substantially surrounding the lamp;

g. a lens system mounted on the base between reflector and the cover; and h. a template/shutter system mounted on the base in juxtaposition with the lens system and the reflector.

2. The projector of claim 1, wherein the top, bottom and side walls of the housing are each made of a flat plate having substantially parallel longitudinal edges and wherein said plates are secured along their adjacent edges, the housing further including a seal between adjacent edges of adjacent plates for hermetically sealing the housing.

3. The projector of claim 1, wherein a second end opposite said one open end of the housing is also open and wherein the base may be inserted in and removed from the housing through the second open end, the projector further including an end wall mounted on the base and adapted for closing the second open end when the base is fully inserted in the housing.

4. The projector of claim 3, further including a seal between the housing and the end wall on the base for hermetically sealing the housing when the base is fully inserted in the housing.

5. The projector of claim 1, wherein the base further includes an elongated channel extending longitudinally along the base, and wherein the lens system and the template/shutter system include mounts adapted to be received in the channel.

6. The projector of claim 5, wherein the lens system is selectively and independently movable relative to the base.

7. The projector of claim 6, including means for releasably securing the lens system in position relative to the base.

8. The projector of claim 1, wherein the opposite sidewalls of the housing each include an elongated track extending longitudinally along the interior of the housing and wherein the base is adapted to be slidably received in the tracks.

9. The projector of claim 1, wherein the lamp is selectively movable relative to the reflector.

10. The projector of claim 9, wherein the base includes a lamp support and a lamp bracket movably mounted on the support, and wherein the lamp socket is mounted on the bracket.

11. The projector of claim 10, wherein the lamp support comprises a first generally U-shaped member fixedly mounted on the base and wherein the lamp bracket comprises a second generally U-shaped member received in the first member, and wherein the lamp is secured to the second member on the outside of the base of the U, and wherein a plurality of through fasteners secure the legs of the respective U-shaped members to one another.

12. The projector of claim 11, wherein the U-shaped members are secured such that they are movable relative to one another.

13. The projector of claim 9, further including means for aligning the lamp.

14. The projector of claim 13, wherein the means for aligning the lamp includes a through aperture on in the reflector through which light can pass and a target on a remote interior surface of the projector upon which the passed light is aimed for positioning the lamp relative to the reflector.

15. The projector of claim 9, wherein the lamp is adjustable in both the horizontal and vertical planes.

16. The projector of claim 1 wherein said lamp is a metal halide lamp.

17. An exterior framing projector for projecting a framed light image on an exterior surface, the projector including a housing having top, bottom, and opposite side walls and opposite ends, at least one of which is open, a clear cover over said one open end, a lamp mounted in the housing in axial alignment with the cover, a reflector mounted in the housing substantially surrounding the lamp, a lens system mounted in the housing between reflector and the cover, and a template/shutter system mounted in the housing in juxtaposition with the lens system, the projector further comprising means for hermetically sealing the housing to protect the interior of the housing from the environment.

18. The projector of claim 17, further including a base carried in the housing, wherein the lamp, reflector, lens system and template/shutter system are mounted on the base.

19. The projector of claim 18 further including cooling means for cooling the interior of said housing, and wherein said cooling means includes openings formed through said base.

20. The projector of claim 18, wherein a second end opposite said one open end of the housing is also open and wherein the base may be inserted in and removed from the housing through the second open end, the projector further including an end wall mounted on the base and adapted for closing the second open end when the base is fully inserted in the housing.

21. The projector of claim 18, wherein the base further includes an elongated channel extending longitudinally along the base, and wherein the lens system and the template/shutter system include mounts adapted to be received in the channel.

22. The projector of claim 20, wherein the lens system is selectively and independently movable relative to the base.

23. The projector of claim 17, wherein the lamp is selectively movable relative to the reflector.

24. The projector of claim 23, wherein the base includes a lamp support and a lamp bracket movably mounted on the support, and wherein the lamp is mounted on the bracket.

25. The projector of claim 23, further including means for aligning the lamp.

26. The projector of claim 25, wherein the means for aligning the lamp includes a through aperture in the reflector through which light can pass and a target on a remote interior surface of the projector upon which the passed light is aimed for positioning the lamp relative to the reflector.

27. The projector of claim 17 further including cooling means for cooling the interior of said housing.

28. The projector of claim 17 wherein the top, bottom and side walls of said housing are planar in shape.

* * * * *